US008267384B2

(12) United States Patent
Avant et al.

(10) Patent No.: US 8,267,384 B2
(45) Date of Patent: Sep. 18, 2012

(54) ANNULAR SEAL

(75) Inventors: Marcus A. Avant, Kingwood, TX (US); Rafeal Ramirez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 96 days.

(21) Appl. No.: 12/271,296

(22) Filed: Nov. 14, 2008

(65) Prior Publication Data

US 2009/0066030 A1 Mar. 12, 2009

Related U.S. Application Data

(62) Division of application No. 11/713,183, filed on Mar. 2, 2007.

(51) Int. Cl.
*F16F 7/00* (2006.01)

(52) U.S. Cl. ..... 267/141; 267/141.2; 267/141.3; 267/141.4; 267/180; 267/163

(58) Field of Classification Search ..... 267/141, 267/141.2, 141.3, 141.4, 163, 162, 153, 292, 267/293, 180; 277/336–341, 607
See application file for complete search history.

(56) References Cited

U.S. PATENT DOCUMENTS

| | | | | | |
|---|---|---|---|---|---|
| 699,746 | A | * | 5/1902 | Hall et al. | 248/134 |
| 1,905,103 | A | * | 4/1933 | Johnson | 15/104.19 |
| 1,909,010 | A | * | 5/1933 | Riker, Jr. | 403/226 |
| 2,092,843 | A | | 9/1937 | Henderson | |
| 2,447,319 | A | * | 8/1948 | De Fourchambault | 192/70.21 |
| 2,836,252 | A | * | 5/1958 | Lane | 277/338 |
| 2,893,717 | A | * | 7/1959 | Simmons | 267/161 |
| 2,915,306 | A | * | 12/1959 | Hickman | 267/280 |
| 3,015,482 | A | * | 1/1962 | Maker | 267/180 |
| 3,343,461 | A | | 9/1967 | Tinsley | |
| 3,389,919 | A | * | 6/1968 | Petty | 277/336 |
| 3,545,286 | A | * | 12/1970 | Stenstrom | 248/604 |
| 3,602,490 | A | * | 8/1971 | Mueller et al. | 267/161 |
| 3,879,025 | A | * | 4/1975 | Dillard | 267/165 |
| 3,951,477 | A | * | 4/1976 | Townshend | 384/440 |

(Continued)

FOREIGN PATENT DOCUMENTS

GB 2074635 A 11/1984

OTHER PUBLICATIONS

The American Oil & Gas Reporter; "New Tubular and Connections Capabilities Overcome Downhole Challenges"; Sep. 2005; 5 Pgs.

(Continued)

*Primary Examiner* — Bradley King
*Assistant Examiner* — Mahbubur Rashid
(74) *Attorney, Agent, or Firm* — Cantor Colburn LLP

(57) ABSTRACT

An annular seal device includes a mandrel, at least one cone axially moveable on the mandrel, at least one sealing element having a frustoconical outer surface and a frustoconical inner surface, at least one contact feature at the at least one cone and operably engageable with the at least one sealing element, and at least one of a blocking element and a resilient member at the mandrel, the at least one of a blocking element and a resilient member supporting a blocking surface in opposition to the at least one contact feature. The resilient member itself includes a tubular body having spring rings at axial ends thereof, and a plurality of beams extending spirally from one axial end to the other axial end.

5 Claims, 2 Drawing Sheets

U.S. PATENT DOCUMENTS

| | | | | |
|---|---|---|---|---|
| 4,127,168 | A * | 11/1978 | Hanson et al. | 166/123 |
| 4,206,808 | A * | 6/1980 | Kreft | 166/241.7 |
| 4,269,400 | A * | 5/1981 | Jensen | 267/153 |
| 4,281,840 | A | 8/1981 | Harris | |
| 4,441,721 | A | 4/1984 | Harris et al. | |
| 4,623,991 | A * | 11/1986 | Vitringa | 367/183 |
| 4,749,043 | A | 6/1988 | Rodenberger | |
| 4,753,444 | A | 6/1988 | Jackson et al. | |
| 5,100,114 | A * | 3/1992 | Reuter et al. | 267/293 |
| 5,542,473 | A | 8/1996 | Pringle | |
| 5,915,677 | A * | 6/1999 | Yajima et al. | 267/161 |
| 6,113,082 | A * | 9/2000 | Fujino | 267/103 |
| 6,318,461 | B1 | 11/2001 | Carisella | |
| 6,382,606 | B1 * | 5/2002 | Horng | 267/161 |
| 6,422,791 | B1 * | 7/2002 | Pallini et al. | 405/224.2 |
| 6,769,491 | B2 * | 8/2004 | Zimmerman et al. | 166/387 |
| 6,896,049 | B2 | 5/2005 | Moyes | |
| 2002/0049006 | A1 * | 4/2002 | Zhao et al. | 439/843 |
| 2002/0195256 | A1 | 12/2002 | Metcalfe et al. | |
| 2003/0205858 | A1 * | 11/2003 | Hall et al. | 267/154 |
| 2004/0036225 | A1 | 2/2004 | Ritter et al. | |
| 2004/0065445 | A1 * | 4/2004 | Abercrombie Simpson et al. | 166/382 |
| 2005/0115707 | A1 | 6/2005 | Pedersen et al. | |
| 2005/0279599 | A1 * | 12/2005 | McPherson | 188/379 |
| 2006/0005963 | A1 | 1/2006 | Hiorth et al. | |
| 2006/0156851 | A1 * | 7/2006 | Jacobsen et al. | 74/490.01 |

OTHER PUBLICATIONS

World Oil Magazine; "Suppliers Show Progress in Expandables Innovation"; vol. 227, No. 7; Jul. 2006; Retrieved From the Internet Aug. 4, 2008; http://www.worldoil.com/magazine/MAGAZINE_DETAIL.asp?ART_IDS=2931&MONTH; 5 Pgs.

PCT International Search Report and Written Opinion Mailed June 17, 2008. PCT/US2008/050031. Search Report Having 7 Pages and Written Opinion Having 7 Pages.

* cited by examiner

ANNULAR SEAL

CROSS-REFERENCE TO RELATED APPLICATION

This is a divisional application of U.S. patent application Ser. No. 11/713,183 filed Mar. 2, 2007, the entire disclosure of which is incorporated herein by reference.

BACKGROUND OF THE INVENTION

Annular seals are an often used tool in downhole systems. They are particularly useful and indeed indispensable in, for example, hydrocarbon production systems where complexity is the rule and various strata of a particular formation are productive of different types of fluid. Whether all of the fluids accessed by the well are desirable and simply need to be separately managed or desirable and undesirable fluids are accessed simultaneously requiring exclusionary control of unwanted fluids, annular seals consistently play a significant part.

Considering the importance of annular seals, and the potential "cost" of failure of these seals, it might be expected that the materials used for their construction would be robust. This is not generally the case, however, in that elastomers have long been the seal material of choice due to their sealing ability but are not particularly robust. Elastomers are susceptible to degradation from exposure to heat, pressure swings and chemically harsh environmental species. Since all such derogatory factors are plentiful in the downhole environment of a hydrocarbon well, degradation of annular seals is axiomatic and the requirement for repair thereof regular. The art would unequivocally welcome an annular seal that is more resistant to the commonly existing environmental conditions downhole.

SUMMARY

An annular seal device includes a mandrel, at least one cone axially moveable on the mandrel, at least one sealing element having a frustoconical outer surface and a frustoconical inner surface, at least one contact feature at the at least one cone and operably engageable with the at least one sealing element, and at least one of a blocking element and a resilient member at the mandrel, the at least one of a blocking element and a resilient member supporting a blocking surface in opposition to the at least one contact feature.

A resilient member includes a tubular body having spring rings at axial ends thereof, and a plurality of beams extending spirally from one axial end to the other axial end.

BRIEF DESCRIPTION OF THE DRAWINGS

Referring now to the drawings wherein like elements are numbered alike in the several Figures.

DETAILED DESCRIPTION OF THE DRAWINGS

Figure 1:
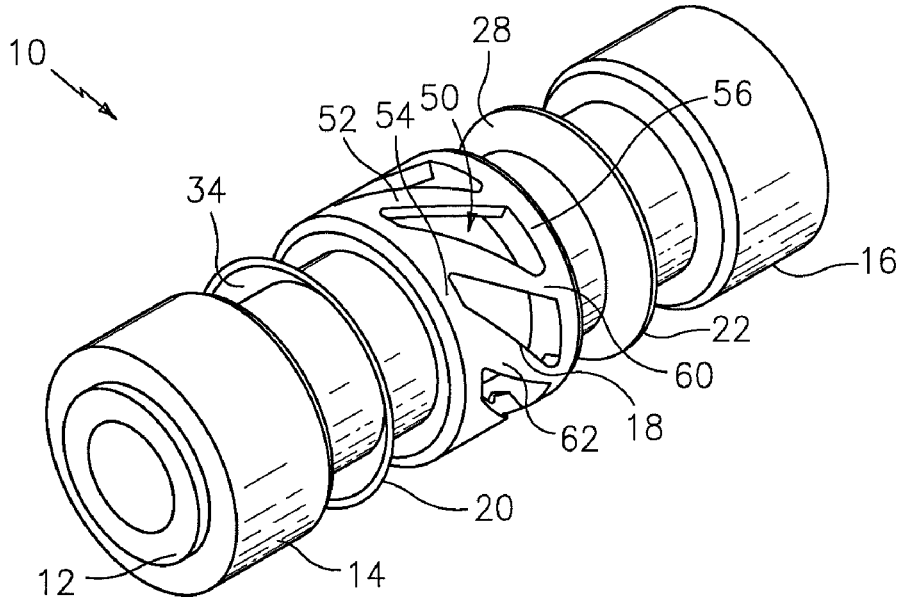
FIG. 1 is a perspective view of an embodiment of an annular seal as disclosed herein.

Referring to FIG. 1, an annular seal device 10 is illustrated in perspective view and in an unactuated position. The depicted embodiment of the seal includes two sealing elements, which promotes greater capability in sealing across high pressure differentials and excellent resistance to pressures from either side of the seal. The embodiment shown will be described in detail herein but it is to be understood that the operative concept is also achievable with a single sealing element; and of course, multiple elements are also contemplated. It is noted that a single element embodiment may exhibit a directional pressure holding capability as opposed to a bidirectional capability.

It is further to be understood that one or more resilient members are desirable to maintain energy in the sealing element(s) but that if a configuration to maintain force on the sealing element is of sufficiently small lost motion that energy remains in the element, a resilient member is not necessary.

Referring back to FIG. 1, a two sealing-element embodiment is shown. This embodiment includes a mandrel 12 extending axially through the annular seal 10 and supporting a pair of cones 14 and 16. Mandrel 12 further supports a resilient member 18 and a pair of sealing elements 20 and 22. Brief reference to FIG. 2 will illustrate the annular seal in an actuated position. The movement of components on a macro scale will be evident upon review of the drawing.

At least one of cone 14 and 16 is moveable upon mandrel 12 in at least an axial direction. Cones 14 and 16 may also be rotationally free or may be rotationally fixed as desired. Whether one or both of cones 14 and 16 are axially moveable, the important thing is that the space between them may be reduced. Such reduction in space between cone 14 and cone 16, when of sufficient magnitude, causes element 20, resilient member 18 and element 22 to be axially loaded between cones 14 and 16. Axial loading as described causes resilient member 18 to elastically deform (some plastic deformation may also occur but is not specifically desired) and causes sealing elements 20 and 22 to reconfigure such that a radial load is placed upon an outside diameter of the mandrel 12 and an inside diameter 24 of a target tubular 26 (see FIG. 2). The radial load on both of these surfaces at the same time and provided by an annularly shaped material (the sealing element 20 or 22), causes an annular seal to result. In the illustrated embodiment, two annular sealing elements are working simultaneously, which improves the capability of the annular seal device to hold pressure in both axial directions.

Each sealing element 20, 22, etc. is configured as a frustocone having a frustoconical outer surface 28 and a frustoconical inner surface 34. It is the frustoconical shape of the elements that allows them to have the action described when axially loaded. A frustocone by nature is possessed of two measurements that one might call "radial". A first is a measurement taken from an inside diameter to an outside diameter, the measurement taken perpendicularly to an axis of the sealing element, the element being at rest. Another measurement one might call "radial" follows the frustoconical surface of the element from the inside diameter to the outside diameter of the element. It will be perfectly clear to one of ordinary skill in the art, the second of these two measurements is of greater length. If, then, the frustoconical shape is put under axial stress sufficient to force the frustocone to become flatter, (or if the visual is easier, shorter when set on a surface like a volcano), the distance of the outer edge of the frustocone from the axis of the frustocone increases and the distance from the inside edge of the frustocone to the axis of the frustocone decreases. Because radial distance between the mandrel 12 and a target tubular 26 is known and does not change, one can easily determine the desired angle of the frustoconical shape for the elements 20 and 22 to provide for optimal radial growth (and inside diameter reduction) upon axial compression of the element. The angle is driven by the distance between the mandrel and the target tubular. The elements 20 and 22 must have sufficient angle in the expanded condition such that the element can maintain its structural integrity. In some embodiments, an angle of about 30 degrees to about 45 degrees is used. The shallower the angle, the larger the range of casing sizes coverable whereas the steeper the angle, the smaller the range of casing sizes coverable but the lower the setting force required. In some embodiments, the element will contact the casing at a range of about 15 degrees to about 20 degrees between the inside diameter of the casing and the element in the actuated condition.

Figure 3:
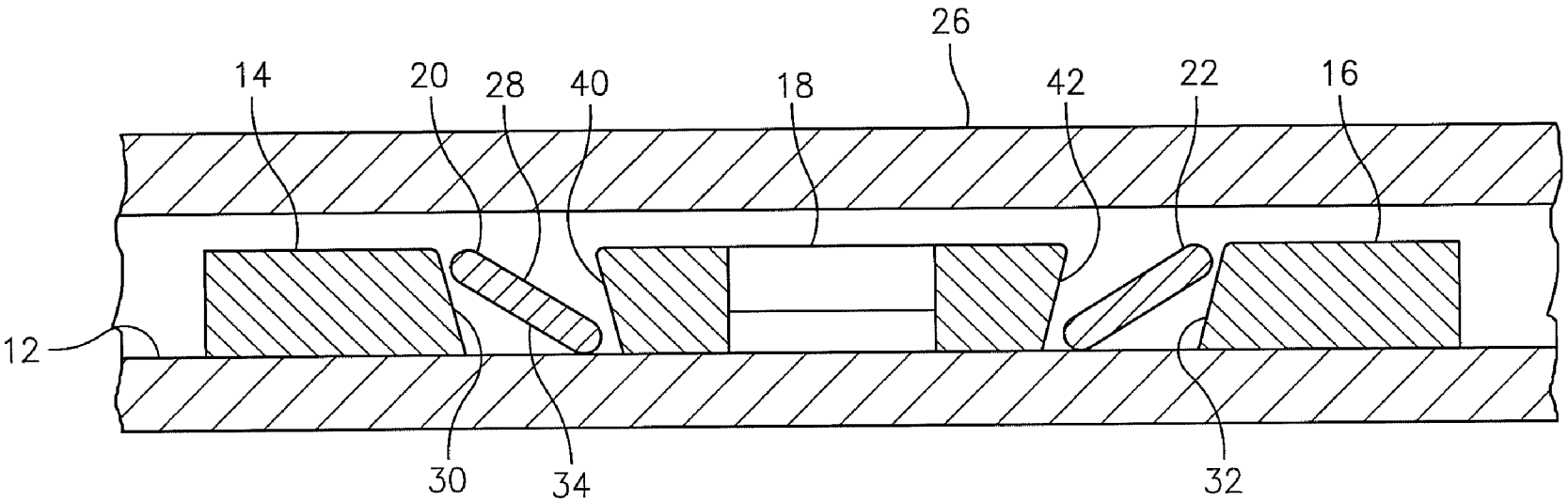
FIG. 3 is a quarter sectional view of the seal as disclosed herein illustrating component positioning and cross-sectional shape.

In order to ensure that axial compression of the elements 20 and 22 occurs as desired, the cones 14 and 16 and resilient member 18 are constructed with specific end profiles discussed hereunder with reference to FIG. 3.

FIG. 3 is a quarter section view of an embodiment of an annular seal device that is consistent with the configuration of FIG. 1. FIG. 3 for clarity contains all numerals utilized in FIG. 1. On cones 14 and 16, it is to be noted that each includes an inclined contact feature. These are identified as 30 and 32, respectively. The inclination of this feature is related to the orientation of the elements 20 and 22. Using FIG. 3 as a visual aid to language herein, feature 30 is inclined in the same direction that element 20 is inclined. The same is true for feature 32 and element 22. An opposing surface for each of feature 30 and 32, respectively is block surface 40 and 42, respectively. The block surfaces 40 and 42 are found on opposite ends of resilient member 18. These surfaces too are inclined in the same general direction as the elements 20, 22 that they are most near. In each case, the inclined surfaces 30, 40, 32, 42 have an inclination that, upon axial compression of all of the components of device 10, encourages the abutting sealing element to deform toward a more perpendicular position relative to an axis of the mandrel 12. In so doing, the element is brought into strong radial contact with both the mandrel and the inside surface 24 of the target tubular 26 thereby creating an annular seal between these two components.

In Addressing resilient member 18 directly, the member is, in the illustrated embodiment, a resilient one but it is to be understood that the reason for the resilience in the member 18 is to maintain energy in the sealing elements 20 and 22. In the event sufficient energy can be maintained without member 18 being resilient, it would not need to be resilient and in such case could simply be a sleeve presenting at least one of surfaces 40 and 42, (depending upon whether there are one or more sealing elements in the particular system.) One possibility for retaining sufficient energy would be a fine ratchet thread (well known in the art) to maintain at least one of the cones in the actuated position. In an embodiment configured as shown in the figures hereof, member 18 is indeed resilient. During actuation of the annular seal device 10, resilient member 18 is compressed. Because to a large extent the compression of resilient member 18 is in the elastic range, the energy stored in the compressed member 18 is available to supplement any lost mechanical axial compression due to pressure reversals in the well. The resilient member may be a coil spring, a spring member as shown, or other resilient material or configuration. Additionally, the member may be configured as a variable constant spring. Any of these configurations are workable providing they are capable of operating elastically at the compression load designed for the particular application.

In the illustrated embodiment, and referring to FIG. 1, a special resilient member 18 is illustrated. Member 18, in this embodiment, is a tubular member having openings 50 therein and obtained through removal of material or being formed into the tubular upon formation thereof. Commonly, the member 18 will be machined in a CNC process to ensure regular opening sharp around the circumference of the member. Each opening 50 comprises (in the illustrated embodiment) a trapezoidal shape. The shape, adjacent other such shapes around the circumference of the member 18 creates a series of beams 52 extending spirally from one spring ring 54 to another spring ring 56, each of which is simply a portion of the tubular member that is not machined away. Beams 52 act as cantilever beams where the bending moment is sustained in a tangential direction to the circumference of the member 18 when the member 18 is put into axial compression. It is the beams that give member 18 its resiliency. It should be noted that the beams and thus the member 18 deflect in a direction that causes one of the rings 54 and 56 to be rotated axially relative to the other. Thus the spring works in torsion to create an axial energy storage device.

The specifically illustrated embodiment in FIG. 1 is also a variable constant spring. The variable constant is achieved by shaping openings 50 such that each beam 52 includes non-parallel borders. Because of this configuration, the beams 52 each have an end 60 that is narrow and an end 62 that is wider. In operation the narrow end 60 will deform first on axial compression, and at a much smaller load than the wider end 62. In addition, since the change in width of the beams is gradual and consistent, the spring constant changes on a constant slope. It also should be pointed out however, that use of the term "gradual" in the previous sentence does not imply a small magnitude of change in the spring constant. In fact, even though the axial length of the beams 52 is not long, the change in spring constant may be, for example, from about 42×10^6 to about 4×10^6, in one embodiment. In order to ensure proper understanding of the effects of the resilient member relative to spring constant, it must be noted that the load on each beam 52 is partially compressive and partially in bending due to the particular configuration of the resilient member 18 as shown. As the member 18 deforms however, the load shifts towards bending and away from compression. The spring constant therefore will be higher initially upon compression of the member 18 because of the relatively larger compressive component of each beam 52 than it will be later in the compression cycle because as the end rings torsionally rotate, the beams are loaded more in bending and less in compression. For example, if each beam in cross section has a constant aspect ratio of 1 along its length, the spring constant would fall as torsion increased due to the loss of the compression component of the deformation. That spring constant can be increased again in the design phase of the member 18 if the cross sectional area of each beam is configured to increase from one end to the other end. The increase can be in arc length or can be in radial thickness or can be both. Depending upon the rate of thickness change, the spring constant of the member can be still be allowed to decrease (as the load transitions toward all bending) with increasing cross sectional area of each beam or it can be made to increase by increasing the rate of change of the cross sectional area of each beam. The spring constant can also be maintained the same if desired by increasing cross sectional area of the beam at the same rate that the change from compression to bending is occurring during torsion of the member 18. The spring rate is automatically adjusted to a useful level even if that means that the spring rate at end 60 is elastically exceeded resulting in a plastic deformation of that end. The configuration of the device simply allows for the plastic deformation to occur and moves deformation to a portion of the beams 52 where the deformation is still within the elastic limits of the beams. The "automatic" movement of the elastic deformation zone continues until either the axial load being placed upon the spring stops growing or the elastic limit is exceeded at end 62 (a highly unlikely circumstance). At whatever load then that plastic deformation stops there is an elastic deformation of the next adjacent area of the beams 52 and it is that area that provides the resiliency desired for operation of one embodiment of the annular seal device. Important to note too is that the configuration allows for a significant range of spring constants such that it may be that no plastic deformation occurs but that only the very first section of the beams are utilized in a specific application.

Figure 2:
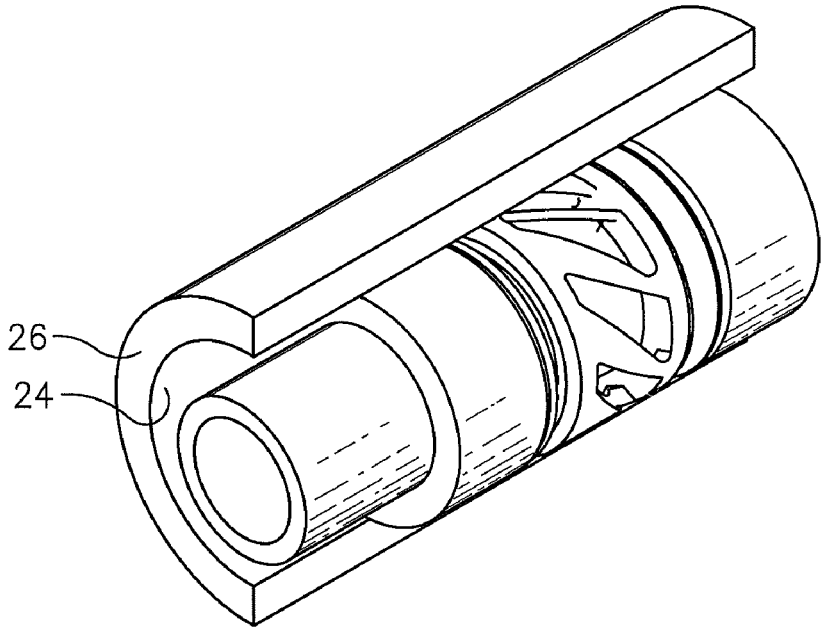
FIG. 2 is a perspective view of the seal of FIG. 1 disposed within another tubular structure (sectioned) and in an actuated position.

In operation of the embodiment illustrated in FIGS. 1 and 2, an axial load is placed on at least one cone 14 or 16 (with the other axially fixed), or an axially directed load could be placed on each cone 14 and 16 in opposite converging directions. In either case, the cones will urge elements 20 and 22 toward and then into contact with resilient member 18. Further application of axial load on one or both cones 14 and 16 causes the resilient member 18 to begin to store energy simultaneously as the elements 20 and 22 are reconfigured to loaded sealing contact with mandrel 12 and tubular 26. Once the seal is achieved, the cones 14/16 are fixed in position. This maintains the load imparted to the elements 20 and 22. Through the life of the seal, pressure reversals in the well will tend to "loosen things up" but the resilient member 18, because of its stored energy, will maintain sufficient sealing load on the elements 20 and 22 to prevent seal failure.

As described, it should be clear to one of ordinary skill in the art that the annular seal device is of significant benefit to the art as the elements 20 and 22 may be constructed of any material desired for a specific application from elastomers, to soft metals (lead, bronze, etc.), to harder materials (stainless steel, inconel, etc.) having extremely high resistance to downhole conditions all while maintaining very simple structure and reliable sealing.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A resilient member comprising:

a tubular body having spring rings at axial ends thereof; and a plurality of beams extending spirally from one axial end to the other axial end the plurality of beams having cross sectional dimensions that change from one axial end thereof to the other axial end thereof and being configured to experience a torsional bending moment in a torsional direction upon axial compression of the resilient member, the rings rotating relative to one another during axial compression of the resilient member.

2. The resilient member as claimed in claim 1 wherein a spring constant of the resilient member is automatically adjustable with axial compression of the member.

3. The resilient member as claimed in claim 2 wherein the spring constant operable for a particular application is automatically selected by compression of the member to a degree dictated by an application in which the resilient member is used.

4. The resilient member as claimed in claim 3 wherein the automatic selection is naturally occurring as elastic limit is reached for successively greater dimensioned portions of the beams resulting in plastic deformation of smaller dimensioned portions of the beams and elastic deformation of the next greater dimensioned portion of the beams.

5. An axially resilient member comprising:

a first ring;

a second ring spaced from the first ring;

a plurality of spirally arranged beams extending from the first ring to the second ring and configured to facilitate axial resilience in the member; and a spring constant that changes with a degree of axial compression of the member, the spring constant changing due to plastic deformation of an end of each of the plurality of beams having smaller cross sectional dimensions leaving a next adjacent portion of each of the plurality of beams in an elastically deformed condition.

* * * * *